US007029423B2

(12) United States Patent
Lear, Jr.

(10) Patent No.: US 7,029,423 B2
(45) Date of Patent: Apr. 18, 2006

(54) CORD-WINDING EXERCISE APPARATUS

(76) Inventor: William M. Lear, Jr., 732 Lakeshore Dr., Lexington, KY (US) 40502

( * ) Notice: Subject to any disclaimer, the term of this patent is extended or adjusted under 35 U.S.C. 154(b) by 482 days.

(21) Appl. No.: 10/155,344

(22) Filed: May 24, 2002

(65) Prior Publication Data

US 2003/0220174 A1 Nov. 27, 2003

(51) Int. Cl.
*A63B 23/14* (2006.01)
*A63B 1/00* (2006.01)
*A63B 21/06* (2006.01)

(52) U.S. Cl. ..... 482/46; 482/40; 482/93

(58) Field of Classification Search ..... 482/38–40, 482/93–94, 99, 102, 44–50
See application file for complete search history.

(56) References Cited

U.S. PATENT DOCUMENTS

| | | | | | |
|---|---|---|---|---|---|
| 2,475,656 | A | | 7/1949 | Bidak | |
| 2,919,134 | A | * | 12/1959 | Zuro | 482/129 |
| 3,738,650 | A | * | 6/1973 | Ossenkop et al. | 482/40 |
| 3,806,121 | A | | 4/1974 | Crossley | |
| 3,982,755 | A | | 9/1976 | Sarich | |
| 4,072,308 | A | | 2/1978 | Applegate | |
| 4,077,403 | A | * | 3/1978 | Steele | 606/241 |
| D264,237 | S | | 5/1982 | McCaleb et al. | |
| 4,438,920 | A | | 3/1984 | Veillette | |
| 4,473,225 | A | * | 9/1984 | Miller | 482/40 |
| 4,645,203 | A | | 2/1987 | Moss | |
| 4,722,523 | A | * | 2/1988 | Yang | 482/108 |
| 4,896,881 | A | | 1/1990 | Djerdjerian | |
| 4,974,836 | A | * | 12/1990 | Hirsch | 482/40 |
| 5,037,087 | A | | 8/1991 | Roth | |
| 5,060,933 | A | | 10/1991 | Cedro | |
| 5,186,696 | A | * | 2/1993 | Pfefferle et al. | 482/40 |
| 5,312,309 | A | | 5/1994 | Fox | |
| 5,380,261 | A | | 1/1995 | Mora | |
| 5,547,441 | A | | 8/1996 | Mora | |
| 5,620,398 | A | | 4/1997 | Moriarty | |
| 5,709,630 | A | | 1/1998 | Froelich, Sr. et al. | |
| 5,967,949 | A | | 10/1999 | Davenport | |
| 6,019,704 | A | | 2/2000 | Morgan | |
| 6,099,437 | A | | 8/2000 | DeMers | |
| 6,234,934 | B1 | | 5/2001 | Gorczyca | |
| 6,652,419 | B1 | * | 11/2003 | Rota | 482/27 |

* cited by examiner

*Primary Examiner*—Stephen K. Cronin
*Assistant Examiner*—Fenn C. Mathew
(74) *Attorney, Agent, or Firm*—Stoll Keenon Ogden, PLLC; Mark Taylor

(57) ABSTRACT

A cord-winding exercise apparatus for exercising wrists and forearms configured for mounting in a doorway, and for supporting at least one weight member to provide gravitationally influenced resistance, including a winding bar; at least one cord attached to the winding bar; an arrangement attached to the at least one cord for supporting the at least one weight member; and at least two brackets for mounting to a door frame, each bracket being formed with a winding bar receiving area for receiving and releasably supporting the winding bar in a rotatable, cord winding position wherein the door frame restricts lateral movement of the winding bar while the winding bar is disposed within the brackets.

23 Claims, 4 Drawing Sheets

CORD-WINDING EXERCISE APPARATUS

BACKGROUND OF THE INVENTION

The present invention relates broadly to exercise equipment and, more specifically a cord-winding exercise apparatus that can be easily mounted in a conventional doorway, and can be easily set up and removed to allow ease of use while allowing normal operation of the door.

Individuals engaged in sports such as golf and other sports that involve clubs, rackets, bats, or throwing objects often find it desirable and beneficial to engage in exercises that strengthen the wrists and forearms. Currently, forearm exercisers tend to be either bulky or overly simplistic apparatus that often do more harm than good.

Among one of the more simple apparatus for such exercise is a broom handle having a rope attached thereto and a water jug or other weight tied to the end of the rope. The person seeking exercise then holds the broom handle with outstretched arms, then twists the handle to wrap the rope around the handle, thereby lifting the weight.

The results achieved from such exercise can include lower back pain, inefficient exercise and other, more serious problems due to the naturally haphazard positioning of the broom handle. Attempts to hold the otherwise unsupported broom handle with outstretched arms at a reasonable position to effectively exercise wrists and forearms usually provides poor results due to the otherwise unsupported broom handle twisting and generally moving about, creating a wildly varying array of directional forces acting on the user through the device even as the user applies generally consistent torque to the broom handle.

Other attempts to overcome these deficiencies have resulted in bulky and cumbersome apparatus which can be difficult and time-consuming to transport, set up and use. These apparatus can range from elaborate, floor-standing exercise machines to complex structures intended for door mounting.

Therefore, there exists a need for a apparatus that will be easy to transport, set up and use while providing effective and safe exercise opportunities.

SUMMARY OF THE INVENTION

It is currently an object of the present invention to provide a cord-winding exercise apparatus for exercising wrists and forearms that is readily transportable and is assembled with a simple screwdriver.

It is another object of the present invention to provide such a cord-winding exercise apparatus that will allow the user to place and maintain the exercise apparatus at the proper orientation for effective use.

To those collective ends, a cord-winding exercise apparatus for exercising wrists and forearms is configured for mounting in a doorway, and for supporting at least one weight member to provide gravitationally influenced resistance. The exercise apparatus includes a winding bar; at least one cord attached to the winding bar; an arrangement attached to the at least one cord for supporting the at least one weight member; and at least two brackets for mounting to a door frame. Each bracket is formed with a winding bar receiving area for receiving and releasably supporting the winding bar in a rotatable, cord winding position wherein lateral movement of the winding bar is restricted while the winding bar is disposed within the brackets.

Preferably, the brackets are formed as generally U-shaped members. Further, the brackets may be formed with a width configured for mounting within a rabbet of a door frame without substantially interfering with door use. Preferably, the brackets are formed from a low-friction material.

It is further preferred that the winding bar is formed from a resilient material whereby the winding bar can flex under gravitational influence of the at least one weight member when the winding bar is mounted to the brackets to direct the cord away from the brackets when the cord is being wound on the winding bar.

The apparatus preferably includes two cords, with each cord attached to the winding bar. The winding bar is preferably formed with one knurled portion forming a single elongate gripping surface, with each of the two cords attached to the winding bar adjacent an end portion of the knurled portion.

Alternately, the winding bar may be formed with two knurled portions forming gripping surfaces spaced a predetermined distance from one another with the at least one cord attached to the winding bar between the knurled portions. In this embodiment, it is preferred that the apparatus include one cord attached to the winding bar at two places intermediate the knurled portions, with the arrangement for supporting the at least one weight member being suspended by the cord at approximately a lengthwise center of the winding bar, whereby when the winding bar is rotated, the cord is wound toward the lengthwise center of the winding bar.

Preferably, the arrangement for supporting the at least one weight member includes at least one threaded member attached to the at least one cord and a toggle wing assembly attached to the at least one threaded member, wherein the toggle wing assembly includes at least one toggle wing element and at least one spring, with the at least one toggle wing element being spring-biased into an extended position and movable against the spring into a folded position.

The toggle wing assembly may include a pair of opposed toggle wing elements and at least one spring, with the toggle wing elements being spring-biased into an spread position and movable against the spring into a folded position.

According to another embodiment, a cord-winding exercise apparatus for exercising wrists and forearms is configured for mounting in a doorway, and for supporting at least one weight member to provide gravitationally influenced resistance, includes at least one cord; a winding bar having the cord attached thereto, the winding bar being formed from a resilient material whereby the winding bar can flex under gravitational influence of the at least one weight member to direct the cord toward a lengthwise center of the winding bar when the cord is being wound on the winding bar; an arrangement attached to the cord for supporting the at least one weight member; and two brackets for mounting to a door frame, each bracket being formed with a winding bar receiving area for receiving and releasably supporting the winding bar in a rotatable, cord winding position wherein lateral movement of the winding bar is restricted while the winding bar is disposed within the brackets.

Preferably, the brackets are formed as generally U-shaped members. Further, the brackets may be formed with a width configured for mounting within a rabbet of a door frame without substantially interfering with door use. It is also preferred that the brackets are formed from a low-friction material.

It is preferred that the arrangement for supporting the at least one weight member include at least one threaded member attached to the at least one cord and a toggle wing assembly attached to the at least one threaded member, wherein the toggle wing assembly includes at least one toggle wing element and at least one spring, with the at least one toggle wing element being spring-biased into an extended position and movable against the spring into a folded position. Preferably, the toggle wing assembly includes a pair of opposed toggle wing elements and at least one spring, with the toggle wing elements being spring-biased into an spread position and movable against the spring into a folded position.

According to another embodiment, a cord-winding exercise apparatus for exercising wrists and forearms configured for mounting in a doorway, and for supporting at least one weight member to provide gravitationally influenced resistance, includes a winding bar, the winding bar being formed with at least two gripping surfaces thereon, the gripping surfaces being spaced a distance apart along the winding bar; one cord attached to the winding bar at two places intermediate the gripping surfaces; an arrangement attached to the cord for supporting the at least one weight member, the arrangement being suspended by the cord at a position spaced from approximately a lengthwise center of the bar, whereby when the bar is rotated the cord is wound toward the lengthwise center of the winding bar; and two brackets for mounting to a door frame, each bracket being formed with a winding bar receiving area for receiving and releasably supporting the winding bar in a rotatable, cord winding position wherein lateral movement of the winding bar is restricted while the winding bar is disposed within the brackets.

It is preferred that the brackets are formed as generally U-shaped members. Preferably, the brackets are formed with a width configured for mounting within a rabbet of a door frame without substantially interfering with door use. It is further preferred that the brackets are formed from a low-friction material.

Preferably, the arrangement for supporting the at least one weight member includes at least one threaded member attached to the at least one cord and a toggle wing assembly attached to the at least one threaded member, wherein the toggle wing assembly includes at least one toggle wing element and at least one spring, with the at least one toggle wing element being spring-biased into an extended position and movable against the spring into a folded position. It is further preferred that the toggle wing assembly includes a pair of opposed toggle wing elements and at least one spring, with the toggle wing elements being spring-biased into an spread position and movable against the spring into a folded position.

DESCRIPTION OF THE PREFERRED EMBODIMENTS

Figure 1:
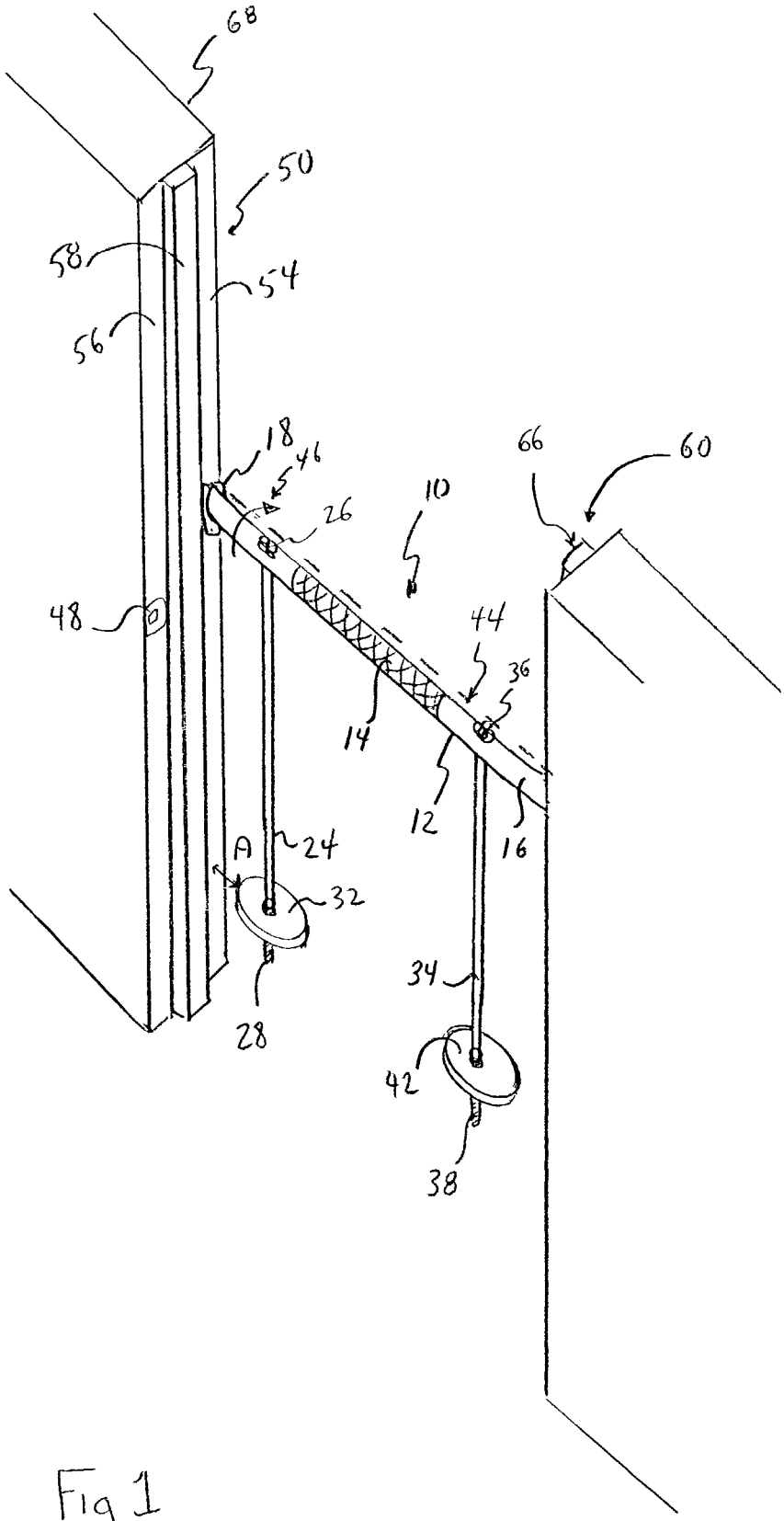
FIG. 1 is a perspective view of a cord-winding exercise apparatus according to a first preferred embodiment of the present invention.

Turning now to the drawings, more particularly to FIG. 1, a first preferred embodiment of the cord-winding exercise apparatus is illustrated generally at 10 and shown in a position ready for use, mounted to a door frame 50, as will be explained in greater detail hereinafter.

Figure 2:
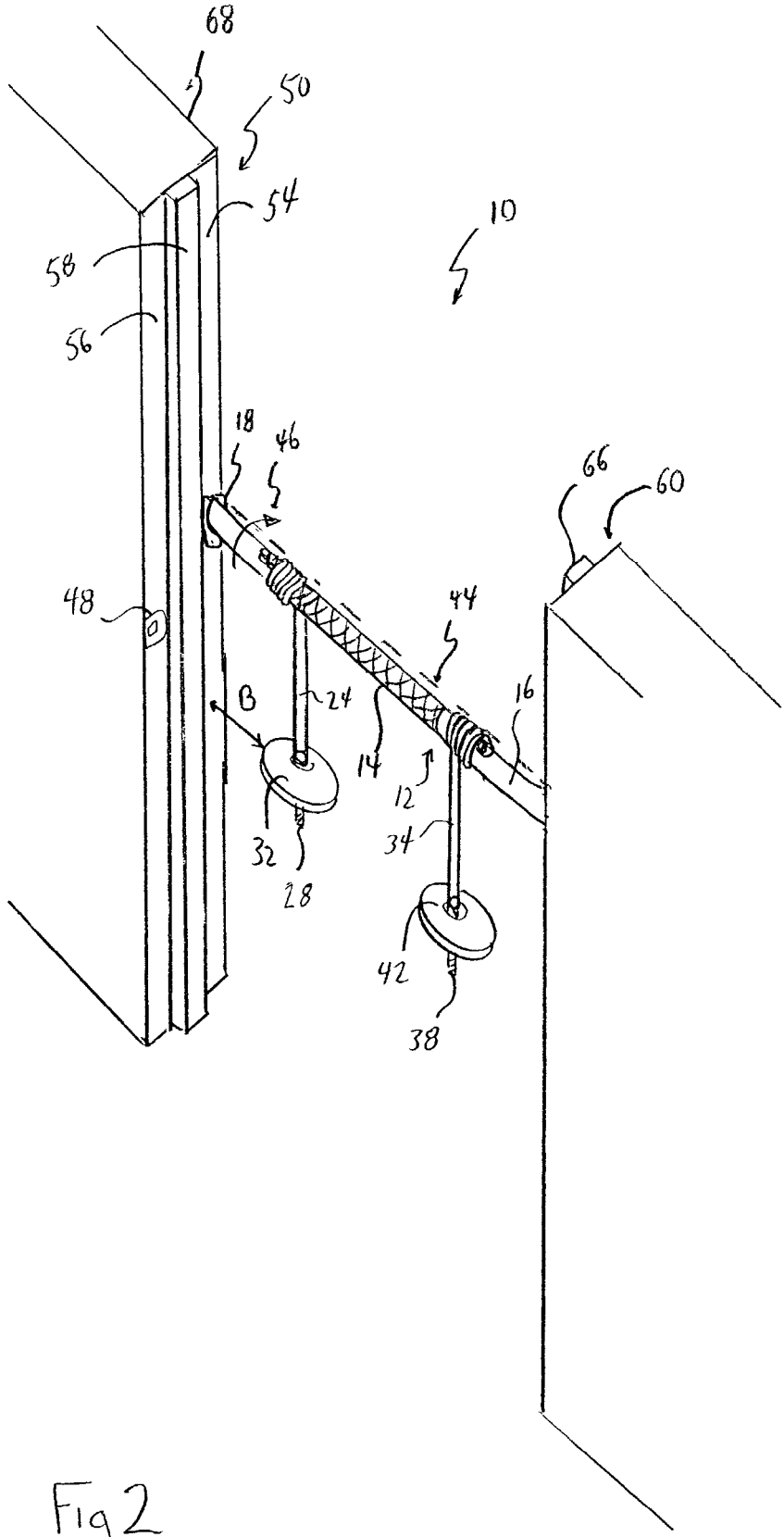
FIG. 2 is a perspective view of a cord-winding exercise apparatus illustrated in FIG. 1, shown with a partially wound cord.
Figure 3:
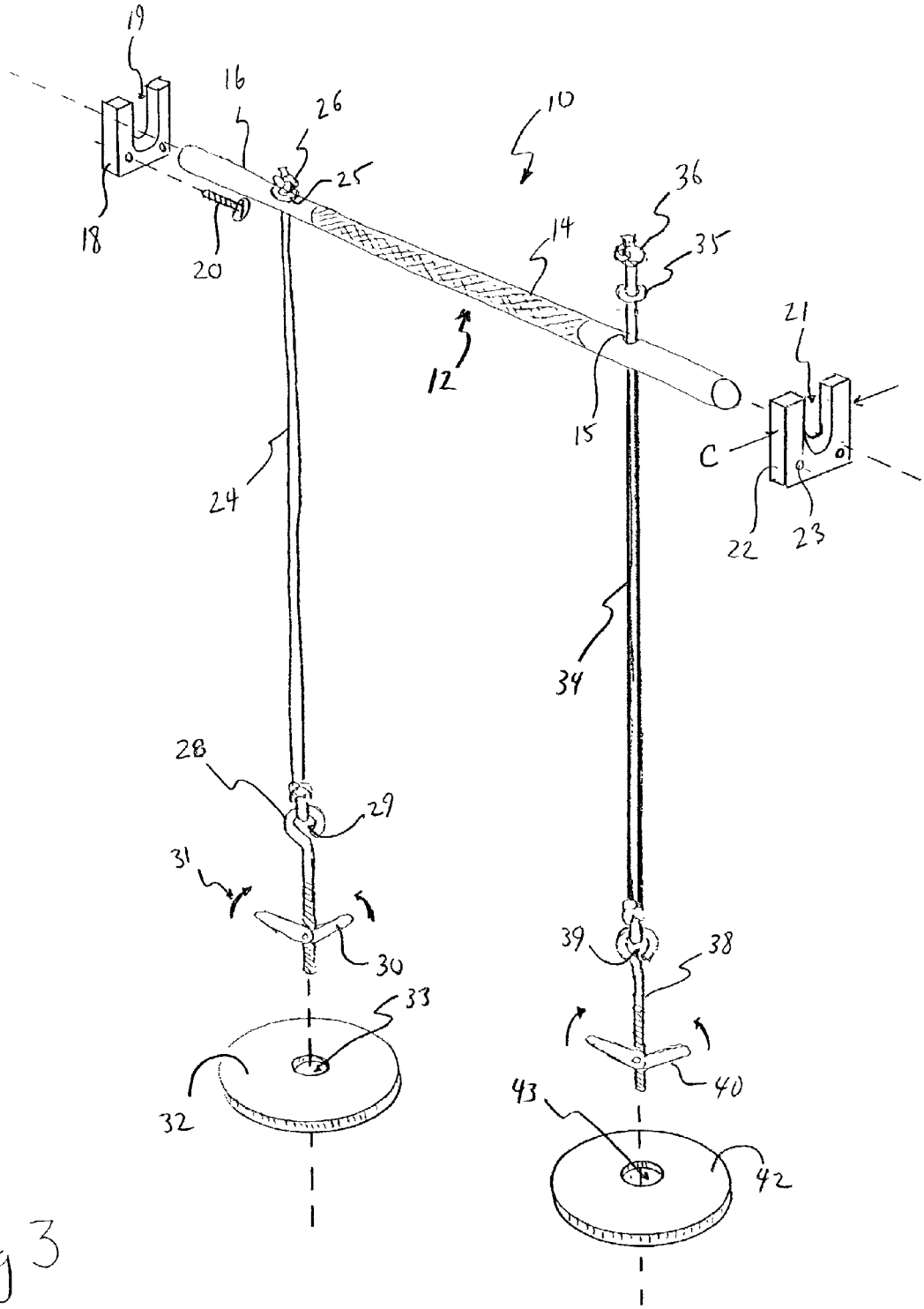
FIG. 3 is an exploded view of the cord-winding exercise apparatus illustrated in FIG. 1.

With reference to FIG. 3, the first preferred embodiment of the cord-winding exercise apparatus 10 includes a winding bar 12. The winding bar 12 is a generally cylindrical rod formed with the diameter suitable for hand gripping and a length suitable for extending between upright components of a door frame 50, as seen in FIGS. 1 and 2. As will become apparent hereinafter, the first preferred embodiment of the winding bar 12 is formed from nylon, plastic, silicon or some other generally resilient material which will allow the winding bar 12 to flex downward slightly when mounted in a door frame 50.

With continued reference to FIG. 3, the winding bar 12 is formed with a knurled gripping surface 14 which extends in both directions from a lengthwise center of the winding bar 12 for a predetermined distance. The gripping surface 14 may be etched into the material or may be applied as a coating. The presence of a gripping surface 14 and the abbreviation thereof defines two non-gripping portions 16 at either end of the winding bar 12. A hole 15 is formed in each non-gripping portion 16 for cord threading, as will be explained in greater detail hereinafter.

The exercise apparatus further includes a pair of brackets 18, 22 that are mounted to a rabbeted portion of a door frame illustrated at 54 in FIG. 1. As seen in FIG. 3, the brackets 18, 22 each include a generally U-shaped recess 19, 21 formed therein to receive respective ends of the winding bar 12. The brackets are preferably formed with a width dimension indicated at C in FIG. 3 that is equal to or less than the width of the rabbeted portion of the door frame 54 as seen in FIG. 1. This allows the brackets 18, 22 to be secured to the door frame 50 and, if the door frame 50 includes double rabbeted frame, i.e., with rabbeted portions 54, 56 on either side of the door stop 58 as seen in FIG. 1, then the door (not shown for clarity) may still be used in a conventional manner. The brackets 18, 22 include two openings 23 on each bracket 18, 22 through which conventional screws 20 are used to secure the brackets 18, 22 to the door frame 50.

The brackets 18, 22 are preferably formed from nylon, plastic, silicone or other low-friction material to provide a smooth surface for enhanced ease of winding bar movement within the brackets 18, 22. It should be noted that the curved portions of the brackets 18, 22 within the U-shaped recesses 19, 21 provide the friction surfaces for contact with the winding bar 12. It is well within the scope of the present invention to provide the curved surface with a coating of low friction material or otherwise fabricate that portion of the brackets 18, 22 from a low friction material with the remainder of each bracket being formed from some other material.

By mounting the brackets 18, 22 in a doorway, the brackets may be left in place while the winding bar 12 is inserted and removed selectively for exercise purposes. As previously stated, if the door is of a double rabbeted construction, then the brackets 18, 22 are mounted to a first rabbeted portion 54, while the rabbeted portion 58 that contains the strike plate 48 which is configured for door receipt, remains open. By positioning the brackets 18, 22 in the open rabbeted portions 54, 60 of a door frame, a natural space between walls 60 may be used to support the winding bar 12 at a position for exercising and in a manner that focuses the exercise on the wrists and forearms while relieving the user's back of the burden of supporting the entire exercise system. It should also be noted that, in lieu of a doorway, a frame structure can be used, with the brackets 18, 20 mounted thereto.

As seen in FIGS. 1–3, and, more particularly in FIG. 3, two cords 24, 34 are attached to the winding bar 12 through openings 15 formed in the winding bar 12. The cords 24, 34 may be formed from nylon or virtually any flexible, strand material. Once the cords 24, 34 are passed through the openings 15, washers 25, 35 are inserted over each cord 24, 34 and the cord ends are knotted, as illustrated at 26 and 36 to prevent passage back through the openings 15. It should be noted that the cords 24, 34 should be of substantially equal length but this is not an absolute requirement. Due to the adjustability of the weight supporting arrangement, as will be seen in greater detail hereinafter, adjustments can be made to balance weights 32, 42 suspended from the cords, 24, 34.

The present apparatus 10 also includes an arrangement to hold weights for exercise. It should be noted that the weights, illustrated at 32 and 42 in FIGS. 1–3 may be virtually any structure that can effectively attach to the cords but it is preferred that the weights be of the toroidal type which are used with barbells. These commonly available weights provide symmetric weight placement in addition to the ability to be held in place by the weight holding arrangement. As illustrated herein, the weights 32, 42 include openings 33, 43 passing centrally therethrough. The arrangement to hold the weights includes two eye-bolts 28, 38 that are attached to their respective cords 24, 34 by being knotted through the respective eyes 29, 39 of the eye bolts 28, 38. The eye-bolts 28, 38 each include a generally elongated shank that is threaded. Each eye-bolt 28, 38 is fitted with a pair of toggle wings 30, 40 which are commonly available in hardware stores for home use. The toggle wings 30, 40 screw onto the threaded portions of the eye-bolts 28, 38 and are spring-biased with each toggle wing having the ability to be moved against the spring (not shown) in the direction of arrows 31 illustrated in FIG. 3. The springs bias the toggle wings 30, 40 into the spread position illustrated in FIG. 3. The weights 32, 42 may be slipped on to the weight-holding arrangement by pushing a respective toggle bolt 28, 38 through a respective opening 33, 43 in a respective weight member 32, 42. The toggle wings 30, 40 are folded against the respective springs and, once the toggle wings 30, 40 pass through the openings 33, 43, in the weights 32, 42, the springs bias the toggle wings 30, 40, back into a spread position and each weight 32, 42 is retained thereon. As may be appreciated, the toggle wings 30, 40 may be adjusted along the threaded portions of the eye-bolts 28, 38 in order to compensate for any inequalities in cord length.

One of the important features of the present invention is the ability of the cords 24, 34 to consistently and automatically wind toward the lengthwise center of the winding bar 12 when the apparatus 10 is in use. As seen in FIGS. 1 and 2, this feature of the apparatus 10 causes the weights to move from a first distance from the door frame 50 as illustrated in FIG. 1 at A to a second, greater distance from the door frame 50 as illustrated in FIG. 2 at B. In the first embodiment of the present invention, this tendency is caused by the slight flexibility of the winding bar 12. This is illustrated in FIGS. 1 and 2 wherein the winding bar 12 deviates from a true linear path between the door frame portions 50, 60 as indicated by the linear dotted line illustrated at 44. This "sag" causes the cords 24, 34 to wrap around the winding bar 12 toward the linear center thereof and thereby prevents the weights 32, 42 from unwanted contact with the door frames 50, 60 which could interfere with exercise, damage the door frames 50, 60, or both. As will be seen in greater detail, this trait is also present in the second preferred embodiment of the present invention.

Figure 4:
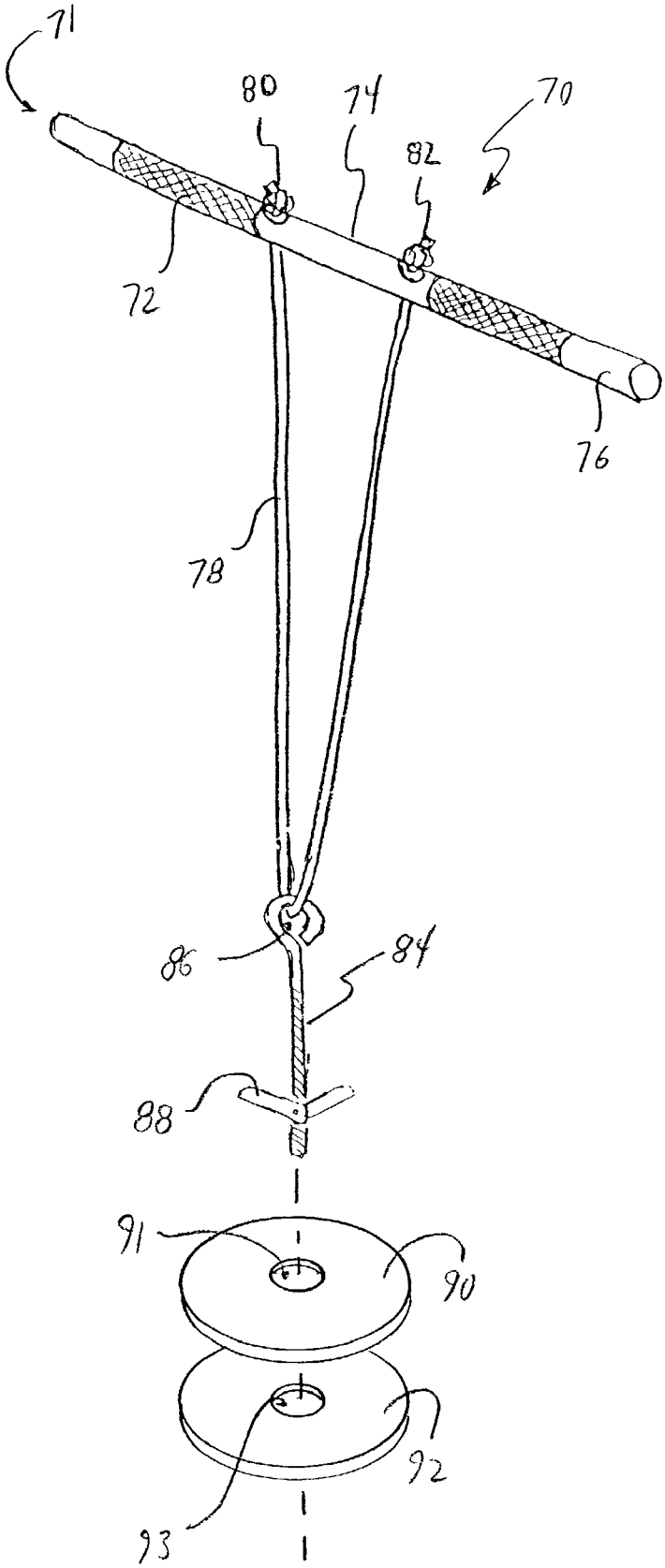
FIG. 4 is an exploded view of a cord-winding exercise apparatus according to a second preferred embodiment thereof.

Turning now to FIG. 4, the second preferred embodiment of the present invention is illustrated generally at 70 and includes a winding bar 71. The winding bar 71 is essentially the same size as the first winding bar 12. The second winding bar 71 includes two gripping regions 72 spaced a distance from one another. This provides a central, non-gripping region 74 and two non-gripping end regions 76. It should be noted that while gripping is intended on the gripping surfaces 72, there is no reason why the central area 74 should be kept free of knurling or other gripping elements. Nevertheless, it is important that when the second embodiment of the winding bar 74 is used, the user grips the winding bar 71 on the gripping surfaces 72.

A single cord 78 is laced through two openings in the winding bar 71 similar to the openings 15 formed in the first winding bar 12. The cord 78 should be approximately twice the length of the two cords 24, 34 appearing in the first embodiment. The second embodiment uses only one eye-bolt, illustrated at 84, and the cord 78 should be threaded through the eye 86 of the eye-bolt 84 prior to threading opposite ends of the cord 78 through respective openings in the winding bar 71 and through a washer, such as the washer illustrated at 15 in FIGS. 1–3. Once this is accomplished, knots 80, 82 can be formed in the cord 78 to prevent the cord 78 from slipping through the openings in the winding bar 71.

As was the case previously, toggle wings 88 may be threaded onto the threaded portion of the eyebolt 84 to accept a weight or weights 90, 92 in a manner previously described. FIG. 4 illustrates a pair of weights 90, 92, each including openings 91, 93 as previously described. It should be apparent that two weights 90, 92, as illustrated in FIGS. 1–3, disposed on the single weight holding arrangement would be necessary to provide the same gravitationally induced resistance as was required with the first embodiment, although other multiple and single weight configurations are possible.

When the winding bar 71 is suspended from brackets 18, 22 as previously described, the eye-bolt 84 supporting weights 90, 92 should be suspended below approximately the lengthwise center of the winding bar 71. Once the winding bar 71 is wound, the cord 78 will naturally wind toward the lengthwise center, keeping the weights 90, 92 generally under the lengthwise center of the winding bar 71 and winding the cord 78 away from the door frame 50.

In operation, a user would initially determine the winding bar height best suited to the particular user for exercise and then attach the brackets 18, 22 to a rabbeted area 54 of a doorway oppositely from the rabbeted area 56 that include the strike plate 48. Using conventional measuring devices, the brackets 18, 22 should be placed at substantially the same height to achieve a balanced condition and allow the cords 24, 34 to wind properly. The cords 24, 34 can act as plumb bobs and, if conventional measuring equipment were to be unavailable, a first bracket 18 could be installed in the door frame 54 using screws 20 as illustrated in FIGS. 1 and 3. The winding bar 12 could then be inserted in the first bracket 18 and the second bracket 22 positioned according to a level indication from the cords 24, 34.

Once the brackets 18, 22 are screwed in place, the winding bar 12 may be fitted to the brackets, the weights 32, 42 attached in a manner previously described and exercising can commence. A user positions his or her hands on the gripping surface 14 and, alternating hands, applies torque to the winding bar 12 to induce rotation thereof wherein the rotation is resisted by the suspended weights 32, 42.

Operationally, the second embodiment of the present invention is similar to the first embodiment except the gripping surfaces are outside the weights, while in the first embodiment, the gripping surfaces are inside the weights. Except for the directional cord winding feature, both embodiments function essentially the same way to provide effective exercise of wrists and forearms without back strain and without damaging the surroundings.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A cord-winding exercise apparatus for exercising wrists and forearms configured for mounting in a doorway, and for supporting at least one weight member to provide gravitationally influenced resistance, said exercise apparatus comprising:

a unitary winding bar;

at least one cord attached to said winding bar for winding thereabout during rotation of said winding bar;

an arrangement attached to said at least one cord for supporting the at least one weight member; and at least two brackets for mounting to a door frame, each said bracket being formed with a winding bar receiving area defining a bearing surface for receiving and releasably supporting said winding bar in a rotatable, cord winding position wherein lateral movement of said winding bar is restricted while allowing bi-directional rotational movement of said winding bar disposed within said brackets, and upon said bearing surfaces.

2. A cord-winding exercise apparatus according to claim 1 wherein said brackets define bearing surfaces formed as generally U-shaped members.

3. A cord-winding exercise apparatus according to claim 2 wherein said brackets are formed with a width configured for mounting within a rabbet of a door frame without substantially interfering with door use.

4. A cord-winding exercise apparatus according to claim 1 wherein said bearing surfaces are formed from a low-friction material.

5. A cord-winding exercise apparatus according to claim 1 wherein said unitary winding bar is formed entirely from a resilient material whereby said winding bar can flex under gravitational influence of the at least one weight member when said winding bar is mounted to said brackets to direct said cord away from said brackets when said cord is being wound on said winding bar.

6. A cord-winding exercise apparatus according to claim 1 wherein said apparatus includes two cords, with each said cord attached directly to said winding bar.

7. A cord-winding exercise apparatus according to claim 6 wherein said winding bar is formed with one knurled portion overlapping the longitudinal center thereof and forming a single elongate gripping surface, with each of said two cords attached to said winding bar adjacent an end portion of said knurled portion.

8. A cord-winding exercise apparatus according to claim 1 wherein said winding bar is formed with two knurled portions forming gripping surfaces spaced a predetermined distance from one another with said at least one cord attached to said winding bar between said knurled portions.

9. A cord-winding exercise apparatus according to claim 8 wherein said apparatus includes one cord attached directly to said winding bar at two places intermediate said knurled portions, with said arrangement for supporting the at least one weight member being suspended by said cord at approximately a lengthwise center of said winding bar, whereby when said winding bar is rotated, said cord is wound around said winding bar toward said lengthwise center thereof.

10. A cord-winding exercise apparatus according to claim 1 wherein said arrangement for supporting the at least one weight member includes at least one threaded member attached to said at least one cord and a toggle wing assembly attached to said at least one threaded member, wherein said toggle wing assembly includes at least one toggle wing element and at least one spring, with said at least one toggle wing element being spring-biased into an extended position and movable against said spring into a folded position.

11. A cord-winding exercise apparatus according to claim 10 wherein said toggle wing assembly includes a pair of opposed toggle wing elements and at least one spring, with said toggle wing elements being spring-biased into an spread position and movable against said spring into a folded position.

12. A cord-winding exercise apparatus for exercising wrists and forearms configured for mounting in a doorway, and for supporting at least one weight member to provide gravitationally influenced resistance, said exercise apparatus comprising:

at least one cord;

a unitary winding bar having said cord attached directly thereto, said winding bar being formed entirely from a resilient material whereby said winding bar can flex under gravitational influence of the at least one weight member to direct said cord toward a lengthwise center of said winding bar when said cord is being wound on said winding bar;

an arrangement attached to said cord for supporting the at least one weight member; and two brackets for mounting to a door frame, each said bracket being formed with a winding bar receiving area defining a bearing surface for receiving and releasably supporting said winding bar in a rotatable, cord winding position wherein lateral movement of said winding bar is restricted while allowing bi-directional rotational movement of said winding bar disposed within said brackets and upon said bearing surfaces.

13. A cord-winding exercise apparatus according to claim 12 wherein said brackets are formed as generally U-shaped members.

14. A cord-winding exercise apparatus according to claim 13 wherein said brackets are formed with a width configured for mounting within a rabbet of a door frame without substantially interfering with door use.

15. A cord-winding exercise apparatus according to claim 12 wherein said bearing surfaces are formed from a low-friction material.

16. A cord-winding exercise apparatus according to claim 12 wherein said arrangement for supporting the at least one weight member includes at least one threaded member attached to said at least one cord and a toggle wing assembly attached to said at least one threaded member, wherein said toggle wing assembly includes at least one toggle wing element and at least one spring, with said at least one toggle wing element being spring-biased into an extended position and movable against said spring into a folded position.

17. A cord-winding exercise apparatus according to claim 16 wherein said toggle wing assembly includes a pair of opposed toggle wing elements and at least one spring, with said toggle wing elements being spring-biased into an spread position and movable against said spring into a folded position.

18. A cord-winding exercise apparatus for exercising wrists and forearms configured for mounting in a doorway, and for supporting at least one weight member to provide gravitationally influenced resistance, said exercise apparatus comprising:

a unitary winding bar, said winding bar being formed with at least two gripping surfaces thereon, said gripping surfaces being spaced a distance apart along said winding bar;

one cord attached directly to said winding bar at two places intermediate said gripping surfaces;

an arrangement attached to said cord for supporting the at least one weight member, said arrangement being suspended by said cord at a position spaced from approximately a lengthwise center of said bar, whereby when said bar is rotated said cord is wound around said winding bar toward said lengthwise center of said winding bar; and two brackets for mounting to a door frame, each said bracket being formed with a winding bar receiving area defining a bearing surface for receiving and releasably supporting said winding bar in a rotatable, cord winding position wherein lateral movement of said winding bar is restricted while allowing said winding bar is disposed within said brackets, said winding bar being rotatable in either direction on each said bearing surface.

19. A cord-winding exercise apparatus according to claim 17 wherein said brackets are formed as generally U-shaped members.

20. A cord-winding exercise apparatus according to claim 19 wherein said brackets are formed with a width configured for mounting within a rabbet of a door frame without substantially interfering with door use.

21. A cord-winding exercise apparatus according to claim 19 wherein said bearing surfaces are formed from a low-friction material.

22. A cord-winding exercise apparatus according to claim 19 wherein said arrangement for supporting the at least one weight member includes at least one threaded member attached to said at least one cord and a toggle wing assembly attached to said at least one threaded member, wherein said toggle wing assembly includes at least one toggle wing element and at least one spring, with said at least one toggle wing element being spring-biased into an extended position and movable against said spring into a folded position.

23. A cord-winding exercise apparatus according to claim 22 wherein said toggle wing assembly includes a pair of opposed toggle wing elements and at least one spring, with said toggle wing elements being spring-biased into an spread position and movable against said spring into a folded position.

* * * * *